US005375844A

United States Patent [19]

Waud

[11] Patent Number: 5,375,844

[45] Date of Patent: Dec. 27, 1994

[54] GOLFER'S AID

[76] Inventor: Michael J. Waud, P.O. Box 89, Pennington Natal, South Africa, 4184

[21] Appl. No.: 136,906

[22] Filed: Oct. 18, 1993

[51] Int. Cl.[5] ..... A63B 69/36
[52] U.S. Cl. ..... 273/187.6
[58] Field of Search ..... 273/187.6, 192, 190 R, 273/190 A, 190 B, 187.3

[56] References Cited

U.S. PATENT DOCUMENTS

| | | | |
|---|---|---|---|
| 1,091,186 | 3/1914 | Brown | 273/187.6 X |
| 3,343,842 | 9/1967 | Woerner | 273/192 |
| 5,007,646 | 4/1991 | Baber et al. | 273/187.6 |
| 5,211,400 | 5/1993 | Hall et al. | 273/187.6 |

*Primary Examiner*—George J. Marlo
*Attorney, Agent, or Firm*—Hugh E. Smith

[57] ABSTRACT

A golf stroke improvement aid comprising a ring-shaped member for looking through to visually closely encircle the golf ball to be struck during the back swing and strike;

a positioning device for aligning the ring-shaped member in space, including a first elongated rigid rod fixedly radially attached to the ring-shaped member, the first rigid rod having an elongated slot therethrough along a major portion of the length thereof, a second rod having a lower pointed end for fixedly inserting into the ground near the golf ball to be struck and an upper other end having a lug formed thereon, the lug having a lateral hole therethrough with a threaded nut and a threaded bolt extending through the elongated slot and the lateral hole and threadely engaged with the threaded nut such that the first rigid rod is held in longitudinally adjustable operable contact with the second rigid rod for positioning the ring-shaped member conveniently within the golfer's line-of-sight to the golf ball to be struck while, at the same time, locating the sighting means outside of zone defined by the arc of the swung golf club; and a cross-hair element fixedly attached to the ring-shaped member such that the intersection of the hairs more precisely defines the fixed reference point to focus attention on relative to the golf ball.

1 Claim, 3 Drawing Sheets

FIG 1
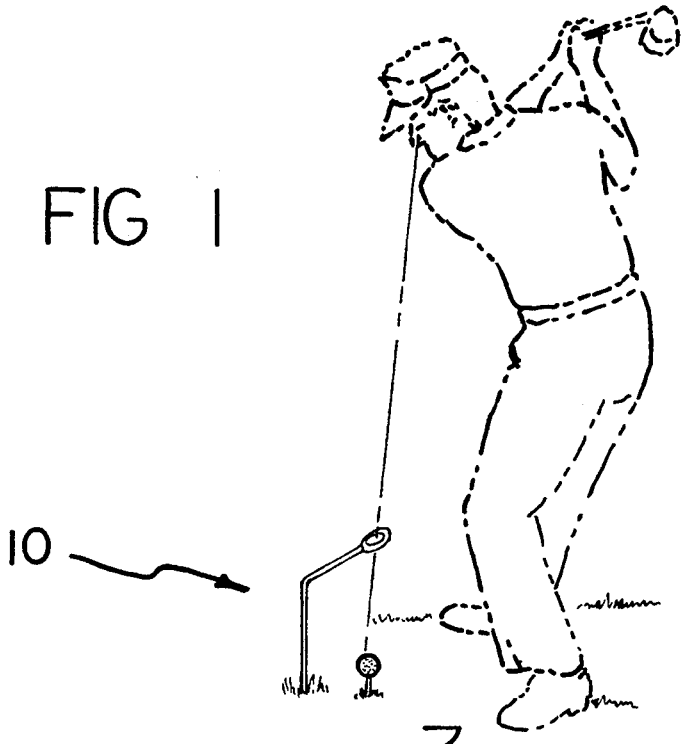
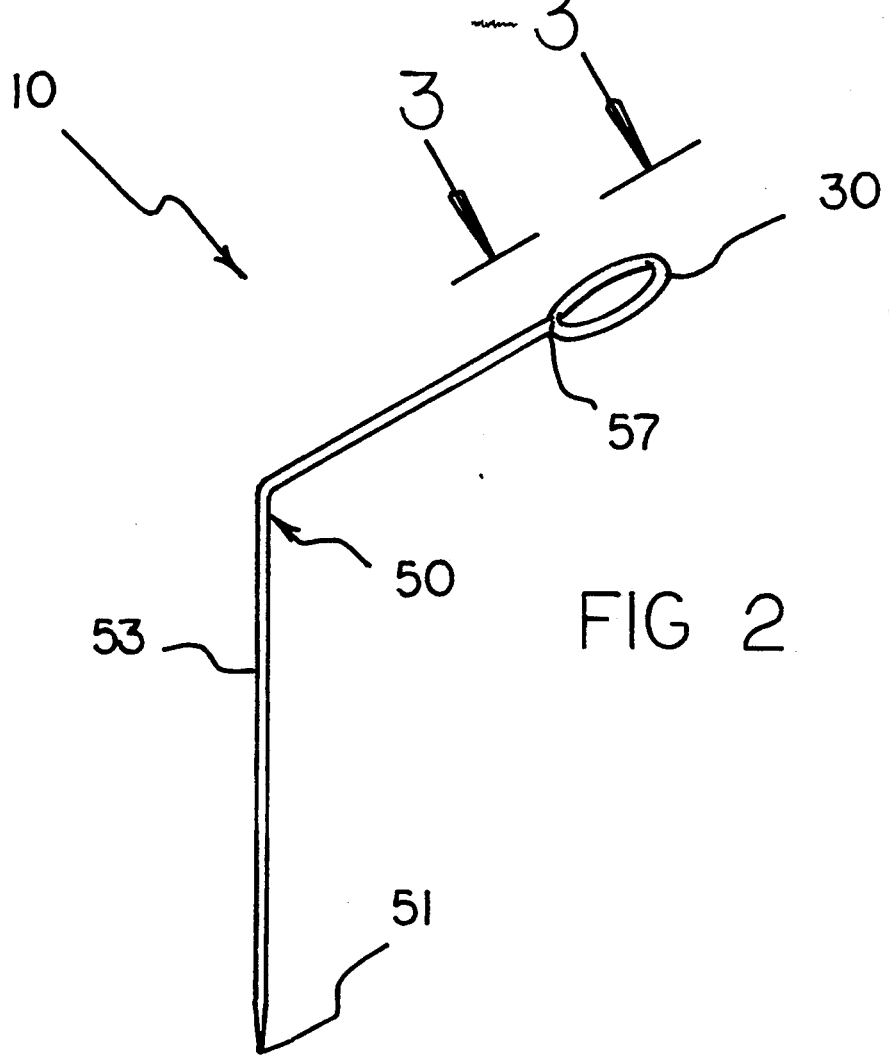
FIG 2

GOLFER'S AID

BACKGROUND OF THE INVENTION

1. Field of the Invention

The present invention relates to golf stroke improvement aids and more particularly pertains to adjustable golf stroke improvement aids which may be used to assist a golfer to maintain an appropriately rigid and repeatable body stance and also to keep his eye trained on the golf ball throughout his back swing and strike.

2. Description of the Prior Art

The use of golf stroke improvement aids is known in the prior art. More specifically, golf stroke improvement aids heretofore devised and utilized for the purpose of improving the accuracy of a golfer's shot are known to consist basically of familiar, expected and obvious structural configurations, notwithstanding the myriad of designs encompassed by the crowded prior art which have been developed for the fulfillment of countless objectives and requirements. The present invention is directed to improving devices for improving the accuracy of a golfer's shot in a manner which is safe, secure, economical and aesthetically pleasing.

For example, U.S. Pat. No. 5,160,143 to Dwyer discloses a golf stroke training device for use with the head of a conventional golf club that includes a body and a pair of opposed legs fastened to the striking surface of the head of the golf club. The golf stroke training device discloses attaches directly to the head of the golf club thereby exposing the device to the force of the shock generated when the golf club strikes the ball whereby the device may be easily jarred from the preferred alignment to the golf club striking surface.

U.S. Pat. No. 4,739,991 to Flinn describes a head positioning aid for positioning a user's head with respect to a remote object such as a golf ball. U.S. Pat. No. 5,052,114 to Levenson et al. describes a golfer's optical alignment instrument which allows a golfer to align the intended target that the golf ball will travel to be aligned perpendicular to a line crossing the golfer's shoe tips whereby aligning the golfer's body to the target. Both the disclosures mentioned heretofore make no provision for maintaining a rigid head position or body stance throughout the golfer's back swing and strike.

The prior art also discloses a golfer's head movement indicating device as shown in U.S. Pat. No. 3,468,545 to Anderson which consists of a view-angle-sensitive optical gage placed on the ground near a golf ball to be struck, and situated within the golfer's field of view while striking the golf ball. The indicating device described in the disclosure is limited to use during relatively dry weather because water droplets formed on the lens surface will tend to distort the optical properties of the lens thereby interfering with the usefulness of the gage. Additionally, the indicating device disclosed does not offer the advantage of simple construction and economic manufacture.

U.S. Pat. No. 4,928,971 to Soles describes a visual alignment system for use in golf clubs which allows for alignment of the golf club with the invisible line for a ball to travel by use of a parallactic indicator formed into the golf club head. The alignment system disclosed has a disadvantage in that the alignment system must be provided for each golf club used. Also, the disclosure does not teach a method for maintaining a rigid head position and body stance throughout the golfer's back swing and strike.

Lastly, U.S. Pat. No. 5,133,556 to Karasavas shows a golf trainer orientation apparatus consisting of a semi-spherical cap for placement on a golf ball with a window permitting meridional markings to be placed on the golf ball relative to a reference plane defined by the device. The disclosure does not teach a method for maintaining a rigid head position and body stance throughout the golfer's back swing and strike. Furthermore, the disclosed invention does not offer the advantage of simple construction and economic manufacture.

In this respect, the golf stroke improvement aid according to the present invention substantially departs from the conventional concepts and designs of the prior art, and in so doing provides an apparatus primarily developed for the purpose of increasing the accuracy of a golf shot.

Therefore, it can be appreciated that there exists a continuing need for new and improved golf stroke improvement aids which can be used to increase the accuracy of a golf shot. In this regard, the present invention substantially fulfills this need.

As illustrated by the background art, efforts are continuously being made in an attempt to devise apparatus to improve the accuracy of golf shots. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of golf stroke improvement aids now present in the prior art, the present invention provides an improved golf stroke improvement aid construction wherein the same can be utilized for increasing the accuracy of golf shots. As such, the general purpose of the present invention, which will be described subsequently in greater detail, is to provide a new and improved golf stroke improvement aid apparatus and method which has all the advantages of the prior art golf stroke improvement aids and none of the disadvantages.

The invention is defined by the appended claims with the specific embodiment shown in the attached drawings. For the purpose of summarizing the invention, the invention may be incorporated into a golf stroke improvement aid for increasing the accuracy of a golf shot by assisting a golfer to maintain an appropriately rigid and repeatable body stance and also to keep his eye trained on the golf ball throughout his back swing and strike.

The golf stroke improvement aid comprising a sighting means for the golfer to focus attention on the golf ball relative to a fixed point while swinging a golf club thereby maintaining a mostly immovable head position and rigid body stance with respect to the golf ball. The sighting means includes a ring-shaped member for looking through to visually closely encircle the golf ball to be struck during the back swing and strike and a positioning means for aligning the ring-shaped member in space.

The positioning means comprising a pliable shaft member having one pointed end for fixedly inserting into the ground near the golf ball to be struck. The ring-shaped member is flexible radially coupled to the unpointed end of the pliable shaft member such that the ring-shaped member may be twisted to any angle relative to the flexible shaft member and the flexible shaft member may be bent to any shape for positioning the ring-shaped member conveniently within the golfer's line-of-sight to the golf ball to be struck while, at the same time, locating the sighting means outside of a zone defined by the arc of the swung golf club so as not to be hit by the golf club during the back swing and strike.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a golf stroke improvement aid for increasing the accuracy of a golf shot by assisting a golfer to maintain an appropriately rigid and repeatable body stance and also to keep his eye trained on the golf ball throughout his back swing and strike, the golf stroke improvement aid comprising: sighting means for the golfer to focus attention on the golf ball relative to a fixed point while swinging a golf club thereby maintaining a mostly immovable head position and rigid body stance with respect to the golf ball, the sighting means including: a ring-shaped member for looking through to visually encircle the golf ball to be struck during the back swing and strike; and positioning means for aligning the ring-shaped member in space, the positioning means comprising: an adjustable shaft member having one pointed end for fixedly inserting into the ground near the golf ball to be struck; the ring-shaped member flexible radially coupled to the unpointed end of the adjustable shaft member such that the ring-shaped member may be twisted to any angle relative to the adjustable shaft member and the adjustable shaft member may be adjusted to any shape for positioning the ring-shaped member contently within the golfer's line-of-sight to the golf ball to be struck while, at the same time, locating the sighting means outside of a zone defined by the arc of the swung golf club so as not to be hit by the golf club during the back swing and strike.

It is therefore an additional object of the present invention to provide a new and improved golf stroke improvement aid which has all the advantages of the prior art golf stroke improvement aids and none of the disadvantages.

It is another object of the present invention to provide a new and improved golf stroke improvement aid which may be easily and efficiently manufactured and marketed.

It is a further object of the present invention to provide a new and improved golf stroke improvement aid which is of a durable and reliable construction.

An even further object of the present invention is to provide a new and improved golf stroke improvement aid which is susceptible of a low cost of manufacture with regard to both materials and labor, and which accordingly is then susceptible of low prices of sale to the consuming public, thereby making such golf stroke improvement aids economically available to the buying public.

Still yet another object of the present invention is to provide a new and improved golf stroke improvement aid which provides in the apparatuses and methods of the prior art some of the advantages thereof, while simultaneously overcoming some of the disadvantages normally associated therewith.

Still another object of the present invention is to provide a new and improved golf stroke improvement aid which is easy to understand and use.

Yet another object of the present invention is to provide a new and improved golf stroke improvement aid which is light weight and convenient to carry on the golf course.

Even still another object of the present invention is to teach a new and improved method for increasing the accuracy of a golfer's shot by controlling head and torso movements and retaining constant eye contact with the golf ball throughout the swing and strike.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the invention illustrating its manner of use.

FIG. 2 is a perspective view of one embodiment of the invention showing a flexible shaft member.

DESCRIPTION OF THE PREFERRED EMBODIMENT

Figure 3:
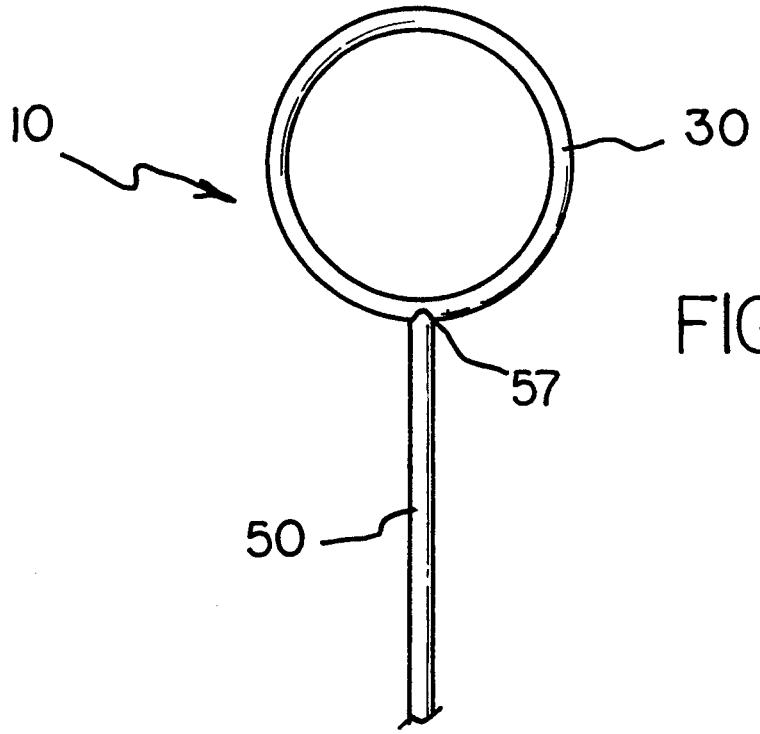
FIG. 3 is a partial elevational view of the invention of FIG. 2 taken along the line 3—3.
Figure 4:
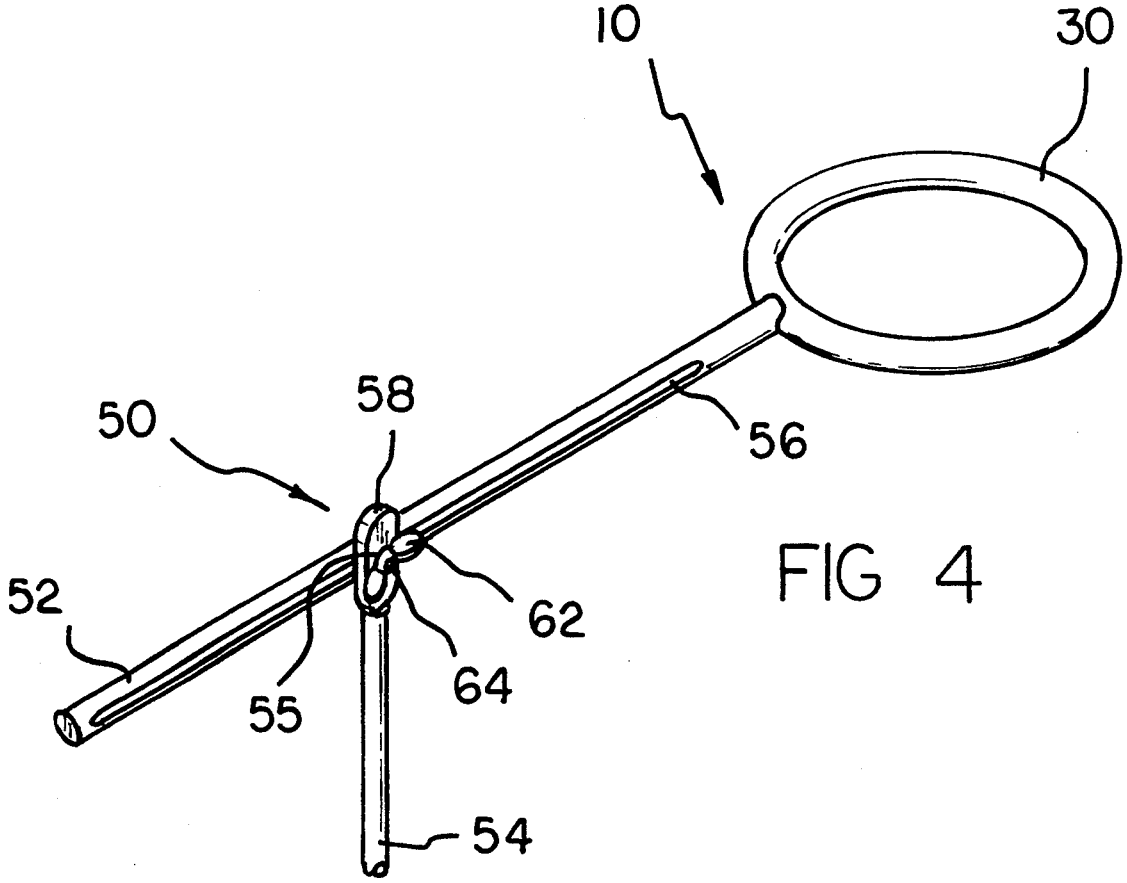
FIG. 4 is a partial perspective view of the first modification of the invention of FIG. 2 wherein the flexible shaft member has been replaced with a two-section adjustable shaft member.

With reference now to the drawings, and in particular to FIG. 1 thereof, a new and improved golf stroke improvement aid embodying the principles and concepts of the present invention and generally designated by the reference numeral 10 will be described.

From an overview standpoint, the golf stroke improvement aid is adapted for use by a golfer to increase the accuracy of a golf shot by assisting the golfer to maintain an appropriately rigid and repeatable body stance and also to keep his eye trained on the golf ball throughout his swing and strike. The golf stroke improvement aid comprises a sighting means including two major components; a ring-shaped member to look through and a positioning member to orient the ring-shaped member in space. See FIGS. 1 through 6. The golfer inserts the shaft member into the ground at a preselected distance from the golf ball, bending or otherwise adjusting it in relation to the golf ball so the ring-shaped member lies in the golfer's line-of-sight to the golf ball such that the ring visually encircles the golf ball when the golfer assumes the appropriate stance. The golfer ensures the golf ball remains fully visible within the perimeter of the ring while executing the swing and strike by controlling head and torso movements and retaining constant eye contact with the golf ball throughout the swing and strike.

With reference now to FIGS. 2 and 3 and more specifically, it will be noted that a golf stroke improvement aid 10 which includes a ring-shaped member 30 for looking through and a positioning means 50 for aligning the ring-shaped member 30 in space. The positioning means 50 comprising a pliable shaft member 53 having one pointed end 51 for fixedly inserting into the ground near the golf ball to be struck. The ring-shaped member 30 is flexible radially coupled to the unpointed end 57 of the pliable shaft member 53 such that the ring-shaped member 30 may be twisted to any angle relative to the flexible shot member 53 and the flexible shaft member 53 may be bent to any shape for positioning the ring-shaped member 30 conveniently within the golfer's line-of-sight to the golf ball to be struck while, at the same time, locating the golf stroke improvement aid 10 outside of a zone defined by the arc of the swung golf club so as not to be hit by the golf club during the back swing and strike.

In a second embodiment (FIG. 4) it will be noted that the positioning means 50 comprises a first rigid rod 52 fixedly radially attached to the ring-shaped member 30, the first rigid rod 52 having a transverse slot 56 therethrough. A second rigid rod 54 having one pointed end (not shown) for fixedly inserting into the ground near the golf ball to be struck, the other end having a lug 58 formed thereon, the lug having a lateral hole 55 therethrough. The positioning means 50 includes a threaded nut 62. The positioning means 50 further includes a threaded bolt 64 extending through the transverse slot 56 and the lateral hole 55 and threadedly engaged with the threaded nut 62 such that the first rigid rod 52 is held in adjustable operable contact with the second rigid rod 54 for positioning the ring-shaped member 30 conveniently within the golfer's line-of-sight to the golf ball to be struck while, at the same time, locating the golf stroke improvement aid 10 outside of a zone defined by the arc of the swung golf club so as not to be hit by the golf club during the back swing and strike.

Figure 5:
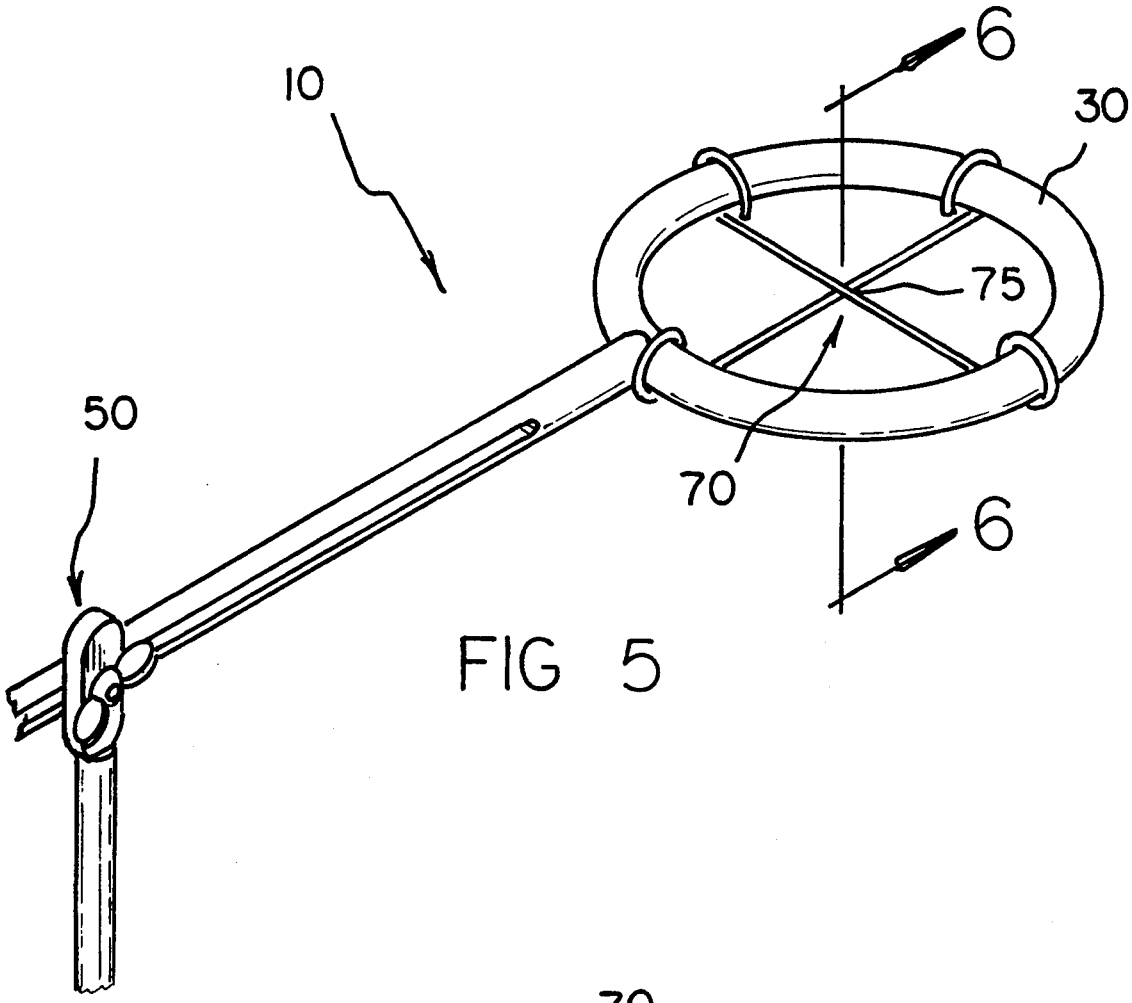
FIG. 5 is a partial perspective view of the invention of FIG. 2 and a second modification which adds a cross-hair member.
Figure 6:
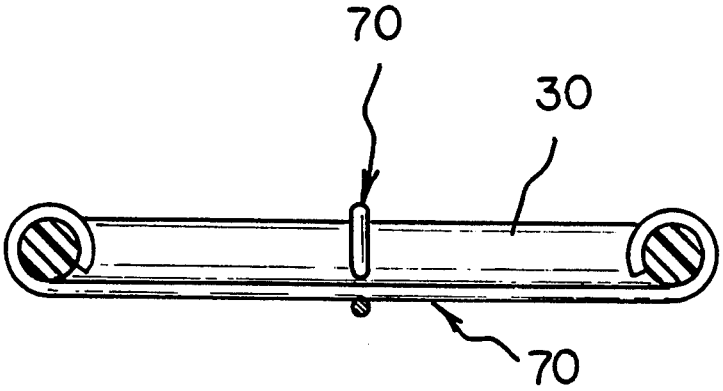
FIG. 6 is a partial sectional view of the invention of FIG. 5 taken along the line 6—6.

A third embodiment of the golf stroke improvement aid 10 illustrated in FIGS. 5 and 6 further includes a cross hair assembly 70 attached to the ring-shaped member 30 such that the intersection of the hairs 75 more precisely defines a fixed reference point while looking through the ring-shaped member 30.

In the operation and use of the apparatus of the present invention, there is provided a method of increasing the accuracy of a golf shot. The above descriptions relate to an apparatus for increasing the accuracy of a golf shot. That comprises a positionable sitting means attached to an adjustable mounting shaft.

More specifically, the method comprises a number of steps in combination. Inserting the shaft into the ground at a preselected distance from the golf ball. Thereafter bending or otherwise adjusting the shaft in relation to the golf ball so that the sighting means lies in the golfers line-of-sight to the golf ball such that the sighting means visually encircles the golf ball when the golfer assumes the appropriate stance. Finally, the golfer ensures the golf ball remains fully visible within the perimeter of the sighting means while executing the back swing and strike by controlling head and torso movements by the golfer and retaining constant eye contact with the golf ball throughout the swing and strike.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Now that the invention has been described,

What is claimed as being new and desired to be protected by Letters Patent of the United States is as follows:

1. A golf stroke improvement aid for increasing the accuracy of a golf shot by assisting a golfer to maintain an appropriately rigid and repeatable body stance and also to keep his eye trained on the golf ball throughout his back swing and strike, the golf improvement aid comprising:

sighting means for the golfer to focus attention on the golf ball relative to a fixed point while swinging a golf club thereby maintaining a mostly immovable head position and rigid body stance with respect to the golf ball, the sighting means including:

a ring-shaped member for looking through to visually closely encircle the golf ball to be struck during the back swing and strike;

positioning means for aligning the ring-shaped member in space, the positioning means comprising a first elongated rigid rod fixedly radially attached to the ring-shaped member, the first rigid rod having an elongated slot therethrough along a major portion of the length thereof a second rod having a lower pointed end for fixedly inserting into the ground near the golf ball to be struck and an upper other end having a lug formed thereon, the lug having a lateral hole therethrough with a threaded nut and a threaded bolt extending through the elongated slot and the lateral hole and threadedly engaged with the threaded nut such that the first rigid rod is held in longitudinally adjustable operable contact with the second rigid rod for positioning the ring-shaped member conveniently within the golfer's line-of-sight to the golf ball to be struck while, at the same time, locating the sighting means outside of zone defined by the arc of the swung golf club so as not to be hit by the golf club during the back swing and strike; and a cross-hair element fixedly attached to the ring-shaped member such that the intersection of the hairs more precisely defines the fixed reference point to focus attention on relative to the golf ball while swinging the golf club thereby maintaining a mostly immovable head position and rigid body stance with respect to the golf ball.

* * * * *